US006240973B1

(12) United States Patent
Stone et al.

(10) Patent No.: US 6,240,973 B1
(45) Date of Patent: Jun. 5, 2001

(54) FORMING FABRIC WOVEN WITH WARP TRIPLETS

(75) Inventors: Richard Stone, Carleton Place; Dale B. Johnson, Ottawa, both of (CA)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 09/686,221

(22) Filed: Oct. 11, 2000

(51) Int. Cl.[7] ..... D21F 1/00; D03D 13/00; D03D 11/00

(52) U.S. Cl. ..... 139/383 A; 162/903

(58) Field of Search ..... 139/383 A; 162/903

(56) References Cited

U.S. PATENT DOCUMENTS 4,086,941 * 5/1978 Thompson ..... 139/383 A
5,421,374 * 6/1995 Wright ..... 139/383 A
5,544,678 * 8/1996 Barrett ..... 139/383 A
5,826,627 * 10/1998 Seabrook et al. ..... 139/383 A
5,944,062 * 8/1999 Gampe ..... 139/383 A
5,975,149 * 11/1999 Lee et al. ..... 139/383 A
6,158,478 * 12/2000 Lee et al. ..... 139/383 A

* cited by examiner

*Primary Examiner*—Andy Falik
(74) *Attorney, Agent, or Firm*—Robert A. Wilkes

(57) ABSTRACT

A forming fabric having a paper side layer and a machine side layer comprises at least two systems of weft yarns and a single set of warp yarn triplets. In the fabric weave pattern, each member of each triplet set of warp yarns interweaves with the paper side weft yarns to occupy in sequence segments of an unbroken warp path in the paper side surface, and the members of each triplet interlace in pairs with single machine side layer weft yarns. Each segment in the unbroken warp path is separated by at least one paper side layer weft yarn. The machine side layer interlacing points can be regularly or irregularly spaced. After heat setting, the fabrics typically have a warp fill from about 105% to about 140%, an open area of at least 35% in the paper side surface, and an air permeability typically from about 3,500 to about 8,200 $m^3/m^2/hr$. Paper products made using these fabrics have enhanced printability.

12 Claims, 4 Drawing Sheets

FORMING FABRIC WOVEN WITH WARP TRIPLETS

FIELD OF THE INVENTION

The present invention relates to woven forming fabrics for use in papermaking machines. The forming fabrics of this invention consist essentially of at least two layers or sets of weft yarns, one in the paper side layer of the fabric and the other in the machine side layer of the fabric, which are held together by one set of warps, which are warp yarns in sets of three or triplets. Thus although visually the fabrics of this invention contain at least two layers, these are not separate, interconnected woven structures, and cannot be separated into two distinct self-sustaining woven structures.

BACKGROUND OF THE INVENTION

The known composite forming fabrics comprise two essentially separate woven structures, each of which includes its own sets of warps and wefts, and each of which is woven to a pattern selected to optimise the properties of the layer. The paper side layer provides, amongst other things, a minimum of fabric wire mark to, and adequate drainage of liquid from, the incipient paper web. The machine side layer should be tough and durable, provide a measure of dimensional stability to the forming fabric so as to minimize fabric stretching and narrowing, and be sufficiently stiff to minimize curling at the fabric edges. Numerous fabrics of this type have been described, and are in industrial use.

The two layers of the known composite forming fabrics are interconnected by means of either additional binder yarns, or intrinsic binder yarns. Additional binder yarns serve mainly to bind the two layers together; intrinsic binder yarns both contribute to the structure of the paper side layer and also serve to bind together the paper and machine side layers of the composite forming fabric. The paths of the binder yarns are arranged so that the selected yarns pass through both layers of the fabric, thereby interconnecting them into a single composite fabric.

In these known composite fabrics, additional binder yarns were generally preferred over intrinsic weft binder yarns, as they were believed to cause fewer discontinuities in the paper side surface of the composite fabric. Recently, both single and paired intrinsic warp or weft binder yarn arrangements have been proposed. However, intrinsic weft binder yarns have been found to cause variations in the cross-machine direction mesh uniformity. Composite fabrics in which intrinsic weft binder yarns are incorporated have been found to be susceptible to lateral contraction under the tensile load placed upon them in a papermaking machine. These intrinsic weft binder yarns have also been found to be susceptible to internal and external abrasion, leading to catastrophic delamination of the composite fabric. Further, due to the necessity of having to weave into the fabric structure additional weft yarns to form the paper side layer, and to bind the paper side layer and machine side layer these fabrics are expensive to produce. More recently it has been proposed to use intrinsic warp binder yarns in pairs, so as to overcome at least some of these disadvantages. The use of pairs offers the advantages that the two warp binder yarns can be incorporated in sequence in successive segments of an unbroken warp path in the paper side surface, and that there is more flexibility of choice for the locations at which each member of the pair interlaces with the machine side layer wefts. It is thus possible to optimise the paper side surface to some extent, for example by reducing marking of the incipient paper web, and to improve the machine side layer wear resistance of the fabric, essentially by increasing the amount of material available to be abraded away before catastrophic failure, usually by delamination, occurs. In these fabrics using pairs of warp binder yarns, each of the paper side layer and machine side layer have separate warp yarn systems, one of which completes the paper side layer weave, and the other of which completes the machine side layer weave.

In the following discussion of this invention, it is to be understood that in a notation such as "2×2" the first number indicates the number of sheds required to weave the pattern, and the second number indicates the number of wefts in the pattern repeat. Thus a 2×2 pattern requires two sheds, and there are two wefts in the pattern repeat.

It has now been discovered that it is not necessary to provide a separate machine side layer warp system in a warp tied fabric. It is possible to weave a fabric having acceptable paper making properties by utilizing triplets of warp yarns so that each member of the triplets interweaves separately in sequence with the paper side layer wefts, and so that the members of the triplets interlace in pairs with the machine side layer wefts.

Accordingly, the present invention seeks to provide a forming fabric whose construction is intended at least to ameliorate the aforementioned problems of the prior art.

The present invention further seeks to improve upon the known fabrics in which paired warp binder yarns are used. The present invention seeks to provide a forming fabric having reduced susceptibility to cross-machine direction variations in the paper side layer mesh uniformity than comparable fabrics of the prior art. Additionally, this invention seeks to provide a forming fabric that is resistant to lateral contraction.

This invention also seeks to provide a forming fabric that is more efficient to weave than comparable fabrics utilizing intrinsic weft binder yarns to interconnect essentially separate paper and machine side layer woven structures. This efficiency is further enhanced in some of the preferred embodiments, because it is now possible to weave some of the preferred embodiments of the fabric from a single warp beam, because all of the warp yarns follow essentially similar paths, which have equal path lengths within the weave structure.

Furthermore, this invention seeks to provide a forming fabric that is less susceptible to dimpling of the paper side surface.

In a preferred embodiment, this invention seeks to provide a forming fabric having a lower void volume than a comparable forming fabric utilizing intrinsic weft binder yarns.

This invention additionally seeks to provide a forming fabric that is resistant to delamination.

SUMMARY OF THE INVENTION

In a first broad embodiment the present invention seeks to provide a forming fabric having at least a paper side layer and a machine side layer, which comprises weft yarns interwoven with triplet sets of warp yarns according to a repeating pattern wherein:

(a) each member of each triplet set of warp yarns interweaves with the paper side layer weft yarns to occupy in sequence segments of at least one unbroken warp path in the paper side layer;

(b) each segment in the unbroken warp path is separated by at least one paper side layer weft yarn;

(c) each member of each triplet interlaces with at least one machine side layer weft yarn; and (d) the members of each triplet interlace in pairs together with a single machine side layer weft yarn.

Preferably, the forming fabric includes two layers of weft yarns, the first in the paper side layer, and the second in the machine side layer. Alternatively, the fabric includes three layers of weft yarns, the first in the paper side layer, the second in the machine side layer, and the third in an intermediate layer.

Preferably, the members of each triplet set occupy a single unbroken warp path in the paper side layer.

In a preferred embodiment of this invention, the fabric as woven and prior to heat setting has a warp fill of from 100% to 125%.

In further preferred embodiments of this invention, the fabric after heat setting has a paper side layer having an open area, when measured by a standard test procedure, of at least 35%, the fabric has a warp fill of from 100% to 140%, and the fabric has an air permeability, when measured by a standard test procedure, of from less than about 8,200 $m^3/m^2/hr$, to as low as about 3,500 $m^3/m^2/hr$ at a pressure differential of 127 Pa through the fabric. An appropriate test procedure for determining fabric air permeability is ASTM D 737-96. Paper side layer open area is determined by the method described in CPPA Data Sheet G-18 using a plan view of this layer of the fabric.

It is a requirement of this invention that every paper side layer warp yarn comprises a triplet of warp yarns; each member of each triplet in turn occupies a portion of at least one unbroken warp path in the paper side surface weave pattern. Within the forming fabric overall weave pattern, all of the members of the triplets of warp yarns pass in pairs into the machine side layer to interlace with the same machine side layer weft, so as to form a single coherent fabric. The interlacing locations are knuckles formed by the interlacing of two members of each of the triplets with a single machine side layer weft yarn, so that within the weave pattern repeat all three members of each triplet interlace at least once with a machine side layer weft. The location of interlacing points is largely determined by the weave pattern chosen for the machine side layer.

It can thus be seen that in the fabrics of this invention neither the paper side layer nor the machine side layer contains any conventional warp yarns which interlace only with paper side layer weft yarns, or with machine side layer weft yarns. In the fabrics of this invention, a first group of wefts in the paper side layer, and a second group of wefts in the machine side layer, are held together within the overall weave repeating pattern by a single set of triplet warp yarns, which therefore contribute to both the structural integrity and the properties of both layers. If desired, a third group of wefts can be present, located essentially between the first and the second groups.

The length of the segments in the paper side surface unbroken warp path occupied in sequence by each member of the triplets of warp yarns, and the number of segments within one weave pattern repeat, is open to a wide range of choices. For example, in fabrics discussed below in more detail, one uses a weave pattern with six segments, in which the path occupied in the weave pattern repeat by each member of the triplets is essentially similar, and another uses a weave pattern with four segments, in which the path occupied in the weave pattern repeat of two members of the triplet is essentially similar, and the path occupied by the third member of the triplet is quite different. In the unbroken warp path in the paper side layer each segment will generally occur more than once, for example at least twice, within each complete repeat of the forming fabric weave pattern.

Preferably, each segment in the unbroken warp path in the paper side surface of the paper side layer is separated from an adjacent segment by either 1, 2 or 3 paper side layer weft yarns. Preferably, each segment in the unbroken warp path in the paper side surface of the paper side layer is separated from an adjacent segment by one paper side layer weft yarn. Alternatively, each segment in the unbroken warp path in the paper side surface of the paper side layer is separated from an adjacent segment by two paper side layer weft yarns.

Preferably, within the paper side layer weave pattern, the total segment length or lengths occupied by each member of a triplet of warp yarns occupying the unbroken warp path are identical. Alternatively, the total segment length or lengths occupied by two members of a triplet of warp yarns occupying the unbroken warp path are identical, and the total segment length or lengths occupied by the third member of a triplet of warp yarns is different.

Preferably, within the fabric weave pattern the paths occupied by each member of a triplet of paper side layer warp yarns are essentially the same, and the interlacing points between the warp yarns with the machine side layer wefts are regularly spaced, and are the same distance apart. Fabrics of this type will generally be woven using a single warp beam. Alternatively, within the fabric weave pattern the path occupied by at least one member of a triplet of paper side layer warp yarns is not the same as that occupied by the others, and the interlacing points between the warp yarns with the machine side layer wefts are both not regularly spaced, and not the same distance apart. Fabrics of this type will generally be woven using two warp beams.

Preferably, the weave design of the fabric is chosen such that:

(1) the first, second and third segment lengths in the paper side layer are the same, and the interlacing points between the warp yarns with the machine side layer wefts are regularly spaced; or (2) the first, second and third segment lengths in the paper side layer are the same, and the interlacing points between the warp yarns with the machine side layer wefts are not regularly spaced, and are not the same distance apart; or (3) the first and second segment lengths in the paper side layer are the same, and are different from the third segment length, and the interlacing points between the warp yarns with the machine side layer wefts are regularly spaced; or (4) the first and second segment lengths in the paper side layer are the same, and are different from the third segment length, and the interlacing points between the warp yarns with the machine side layer wefts are not regularly spaced.

Preferably, the paper side layer weave pattern is chosen from a 2×2, 3×3, 3×6 or 4×8 weave design. More preferably the paper side layer weave is chosen from a plain 2×2 weave; a 3×3 weave; and a 4×4 weave. Preferably, the weave design of the machine side layer is chosen from a 4×4, 4×8, 5×5, 6×6 or 6×12 weave design. More preferably the weave design of the machine side layer is chosen from a 3×3 twill, a 6-shed broken twill, or an N×2N design such as is disclosed by Barrett in U.S. Pat. No. 5,544,678. Alternatively, the paper side layer may be combined with a machine side layer woven according to a satin, twill, or broken twill design.

Preferably, the ratio of the number of paper side layer weft yarns to machine side layer weft yarns is chosen from 1:1, 2:1, 3:2, 5:3, or 3:1. More preferably, the ratio is 2:1.

Due to the unique structure of the fabrics of this invention, it is not possible to define a ratio of paper side layer warp yarns to machine side layer warp yarns. Only one member of a triplet appears at a time in the paper side layer, while two members of a triplet appear at a time in the machine side layer. The fabric thus appears to have a 1:2 warp ratio, but this is not meaningful in the context of these fabrics.

In the fabrics of this invention, selection of the paper side layer design and the machine side layer design must meet two criteria: first, each member of each triplet set of warp yarns interweaves in the paper side layer to occupy in sequence the segments of the unbroken warp path, and second in the machine side layer each member of each triplet interlaces with at least one weft yarn, and the members of each triplet interlace in pairs together with a single machine side layer weft yarn. This can be achieved by ensuring that quotients which can be expressed as Q/P and Q/M, in which Q is the total number of sheds, P is the number of sheds required to weave the paper side layer design, and M is the number of sheds required to weave the machine side layer design, is always an integer.

In the simplest embodiments, the fabrics of this invention will be woven according to weave patterns requiring a loom equipped with at least six sheds. This will accommodate a plain weave pattern for both the paper side layer and the machine side layer, and will require three repetitions of the pattern to accommodate the three members of the triplets. However, such a simple embodiment is not generally preferred, as machine side layer wear resistance of the resulting fabric may not be adequate for most applications.

In the preferred embodiments of this invention, either a 2×2 plain weave, or a 3×3 twill weave is used for the paper side layer, combined with a 6-shed twill, a 6-shed broken twill, or an N×2N weave design for the machine side layer. The combination of a 2×2 plain weave with a 6×6 twill will require 18 sheds: the 6×6 twill will require 18, and the 2×2 plain weave will require 6, thus giving quotients of 1 and 3 respectively.

Table 1 summarizes some of the possible paper side layer and machine side layer weave pattern combinations, together with the shed requirements for each.

TABLE 1

| PSL Weave | PSL Sheds, P | MSL Weave | MSL Sheds, M | Total Sheds, Q | Quotient Q/P, Q/M |
|---|---|---|---|---|---|
| 2 × 2 | 6 | 6 × 6 | 18 | 18 | 3, 1 |
| 2 × 2 | 6 | 6 × 12 | 18 | 18 | 3, 1 |
| 3 × 3 | 9 | 6 × 12 | 18 | 18 | 2, 1 |
| 3 × 6 | 9 | 6 × 12 | 18 | 18 | 2, 1 |
| 2 × 2 | 6 | 4 × 4 | 12 | 12 | 2, 1 |
| 2 × 2 | 6 | 4 × 8 | 12 | 12 | 2, 1 |
| 3 × 3 | 9 | 4 × 4 | 12 | 36 | 4, 3 |
| 4 × 8 | 12 | 4 × 4 | 12 | 12 | 1, 1 |
| 4 × 8 | 12 | 4 × 8 | 12 | 12 | 1, 1 |
| 4 × 8 | 12 | 4 × 8 | 12 | 12 | 1, 1 |
| 2 × 2 | 6 | 5 × 5 | 15 | 30 | 5, 2 |
| 3 × 3 | 9 | 5 × 5 | 15 | 45 | 5, 3 |

In the headings to Table 1, "PSL" indicates paper side layer number of sheds P, "MSL" indicates machine side layer number of sheds M, "Total Sheds" indicates the minimum number of sheds Q required to weave the fabric, and Q/P, Q/M are the integer values of the quotients of the number of the sheds required for the paper side layer divided into the total sheds, and the number of sheds required for the machine side layer divided into the total sheds respectively.

Because all of the triplets of warp yarns making up the paper side layer warp yarns are utilized to interlace in pairs with machine side layer weft yarns, this interlacing pattern improves fabric modulus, thus making the fabric more resistant to stretching and distortion, while reducing lateral contraction and any propensity for fabric layer delamination.

An important distinction between prior art fabrics and those of the present invention is the total warp fill, which is given by warp fill=(warp diameter×mesh×100)%. Warp fill can be determined either before or after heat setting, and, for the same fabric, is generally somewhat higher after heat setting. In all prior art composite fabrics, prior to heat setting, the sum of the warp fill in the paper side and machine side layers combined is typically less than 95%. The fabrics of this invention prior to heat setting can have a total warp fill that preferably is greater than 100%, and is typically from 105% to about 125%. After heat setting, the fabrics of this invention have a total warp fill that can be greater than 105%, and is typically from about 105% to about 140%. This possibility to achieve this level of warp fill makes them unique.

In the context of this invention certain definitions are important.

The term "unbroken warp path" refers to the path in the paper side layer, which is visible on the paper side surface of the fabric, of the triplets of warp yarns, and which is occupied in turn by each member of the triplets making up the warp yarns.

The term "segment" refers to the portion of the unbroken warp path occupied by a specific warp yarn, and the associated term "segment length" refers to the length of a particular segment, and is expressed as the number of paper side layer weft yarns with which a member of a triplet of warp yarns interweaves within the segment.

The term "float" refers to a yarn which passes over a group of other yarns without interweaving with them; the associated term "float length" refers to the length of a float, expressed as a number indicating the number of yarns passed over.

The term "interlace" refers to a point at which a specific pair of the three members of a triplet of warp yarns wraps about a machine side weft to form a double knuckle, and the associated term "interweave" refers to a locus at which a single member of a triplet forms a plurality of knuckles with other paper side wefts along a portion of its length.

BRIEF DESCRIPTION OF THE DRAWINGS

The invention will now be described by way of reference to the drawings, (in which.

In each of the schematic cross sectional views of FIGS. 1–4, within the pattern repeat the cut weft yarns shown are numbered from 1, starting with the first machine side layer weft at one side, and finishing with the last paper side layer weft at the other. The arrows A, B, C and D indicate length of the pattern repeat in FIGS. 1–4 respectively. Also, in FIGS. 1–4 the three members shown of one triplet warp set are labelled X, Y and Z. The same weave pattern continues in each direction away from the cross section shown along the length of the fabric. The weave pattern also continues across the width of the fabric, but will be moved laterally so that the interlacing locations with the machine side layer wefts are not always with the same weft.

DETAILED DESCRIPTION OF THE FIGURES

Figure 1:
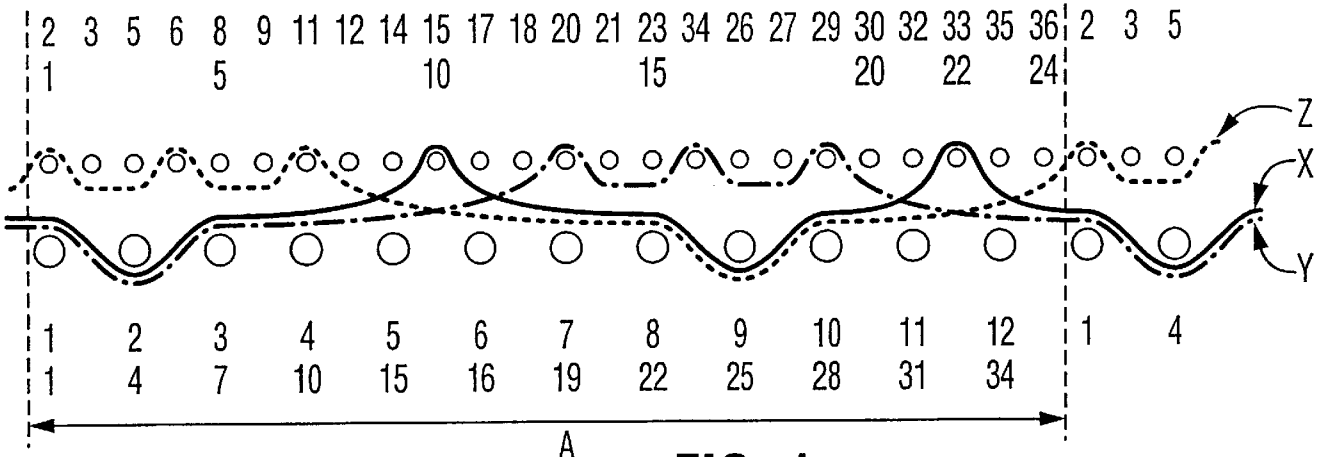
FIG. 1 is a cross sectional view of a first embodiment of a forming fabric according to the invention showing the paths of one triplet of warp yarns in one repeat of the forming fabric weave pattern.

FIG. 1 is a cross sectional illustration of a first embodiment of a forming fabric according to the present invention, taken along the line of one of the warp yarn pairs. In FIG. 1 the paper side layer of the fabric is a 3×3 weave, and the machine side layer is a 6×12 weave according to the N×2N designs in Barrett, U.S. Pat. No. 5,544,678.

The unbroken warp within the paper side layer includes the following four segments:

triplet Z interweaves with wefts 2,6, and 11, passing under the intervening paper side layer wefts;

triplet X interweaves with only weft 15;

triplet Y interweaves with wefts 20, 24, and 29, passing under the intervening paper side layer wefts; and triplet X interweaves with only weft 33.

In the machine side layer there are two interlacing points:

triplets X and Y together interlace with machine side layer weft 4; and triplets X and Z together interlace with machine side layer weft 25.

The fabric of FIG. 1 is woven in 18 sheds; it could also be woven in 36.

It is thus apparent that all three members X, Y and Z of the triplet occupy in sequence segments of the unbroken warp path in the paper side layer which are separated by two paper side layer wefts, and all three members interlace in two pairs with machine side layer wefts.

This relatively simple weave also shows several other features of this invention. Inspection of the paper side layer shows that although the triplets Y and Z follow the same path, with Z shifted along the pattern relative to Y, the triplet X follows a quite different path. The two segments occupied by triplets Y and Z are the same length, and the two occupied by triplet X are also both the same length, but a different length to the other two. Further, within the four segments, triplets Y and Z occupy one segment each, and triplet X occupies the other two. Due to the differing warp path length of triplet X compared to Y and Z, the fabric of FIG. 1 is woven using two warp beams, one for triplet X and the other for Y and Z. If this is not done it is likely that fabric distortion and unequal warp tensions will occur thus impairing the usefulness of the fabric as a forming fabric.

It can also be seen that there are two paper side layer wefts between each segment. Inspection of the machine side layer shows that triplets X and Y interlace at one point, and triplets X and Z at the other; triplets Y and Z do not interlace together with the machine side layer wefts. Further, the interlacing points are not regularly spaced along the pattern: there are six and four machine side layer wefts between them. When taken together, these features indicate a significant level of flexibility in weave diagram choices. At least some of these factors are utilised in the more complex weave pattern of FIG. 2.

Figure 2:
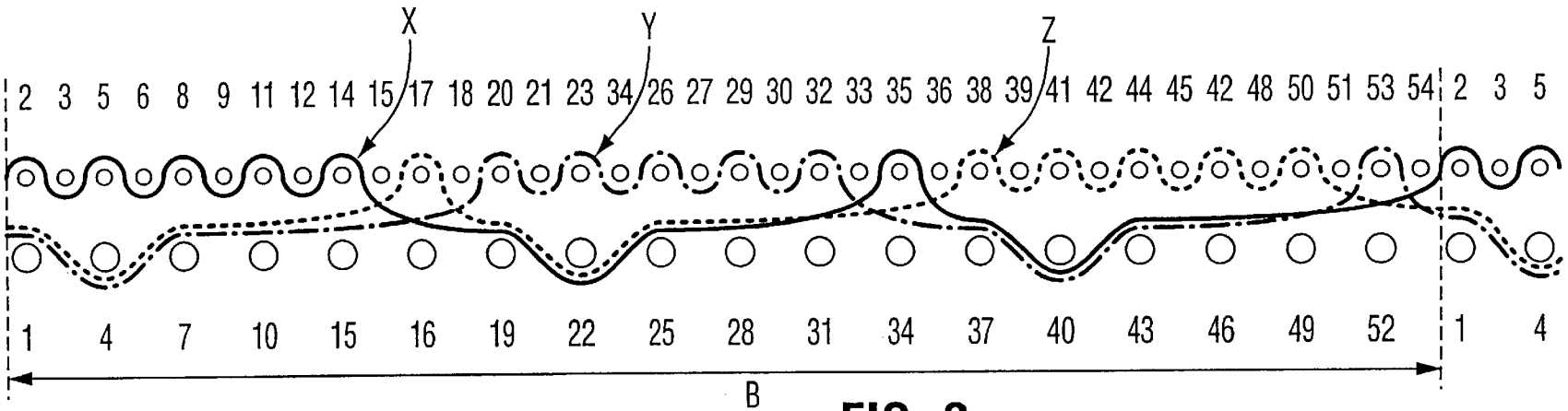
FIGS. 2, 3, and 4A with 4B are cross sectional views similar to FIG. 1 of further embodiments.

In FIG. 2, the paper side layer is a simple 2×2 weave, with only one weft between succeeding segments. In this weave there are six segments:

triplet X interweaves with wefts 2, 5, 8, 11 and 14;

triplet Z interweaves with weft 17;

triplet Y interweaves with wefts 20, 23, 26, 29 and 32;

triplet X interweaves with weft 35;

triplet Z interweaves with wefts 38, 41, 44,47 and 50; and triplet Y interweaves with weft 53.

The machine side layer is a 6 shed twill weave, in which there are three interlacing points which are regularly spaced with five machine side layer wefts between each:

triplets Y and Z together interlace with weft 4;

triplets X and Z together interlace with weft 22; and triplets X and Y together interlace with weft 40.

This fabric is also woven in 18 sheds, and can also be woven in 36.

This more complex weave shows further features of this invention. Within the six segments, the first, third and fifth are all the same length, and although the second, fourth and six are the same length, the length is different to that of the other three segments; the segments are essentially in two sets of three, with the same length within each set. Since each triplet occupies one longer and one shorter segment, each triplet occupies the same overall length within the unbroken weft path. It can also be seen that the paths for triplets X and Y are the same, and that of Z is different. Closer inspection shows the path for triplet Z is the path for X and Y reversed: for X and Y the longer segment comes first, and the shorter one second, and for Z the shorter one comes first, and the longer one second. It can thus be said that all three triplets occupy essentially the same path. Unlike the fabric of FIG. 1, this design can be woven using a single warp beam as the path lengths of each of the triplets is essentially the same. Inspection of the machine side layer shows that in addition to the interlacing points being regularly spaced, all three possible pairings of the triplets are used. In both of these weave diagrams it can be seen that at the interlacing points the pairs of triplets can be recessed to an extent from the wear plane of the fabric by the machine side layer float exposed on the machine side of the fabric, thus potentially increasing fabric life. As the exposed weft float length in the machine side layer weave pattern becomes shorter, e.g. from 5 wefts to 3, the interlacing points are recessed to a lesser degree. Wear at these locations can thus be minimised by choosing a machine side layer weave pattern that will provide long exposed weft float lengths at the desired points. It is also apparent from these diagrams that although the three members of each triplet occupy in sequence the segments of the unbroken warp path, on the paper side surface, the weave pattern does not include any gaps since the pattern continues along the fabric without any breaks.

Figure 3:
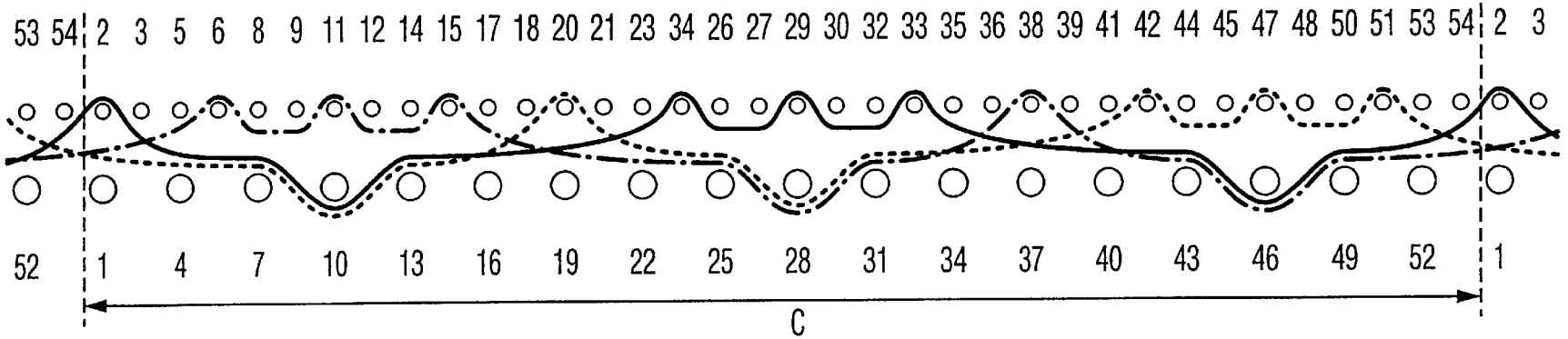

In the fabric of FIG. 3, the paper side layer is a 3×3 twill with two wefts between succeeding segments. In this weave there are six segments:

triplet X interweaves with weft 2;

triplet Y interweaves with wefts 6, 11 and 15;

triplet Z interweaves with weft 20;

triplet X interweaves with wefts 24, 29 and 33;

triplet Y interweaves with weft 38; and triplet Z interweaves with wefts 42, 47 and 51.

The machine side layer is a 6 shed broken twill. There are three interlacing points, which are regularly spaced, with five machine side layer wefts between each:

triplets X and Z together interlace with weft 10;

triplets Y and Z together interlace with weft 28; and triplets X and Y together interlace with weft 46.

This weave is similar to that shown in FIG. 2 in that it utilises six segments of differing lengths in two sets of three, together with regularly spaced interlacing points. In this weave pattern, the paths of all three warps are the same.

The fabric of FIG. 3 is woven in 18 sheds, and can also be woven in 36 sheds.

Figure 4A:
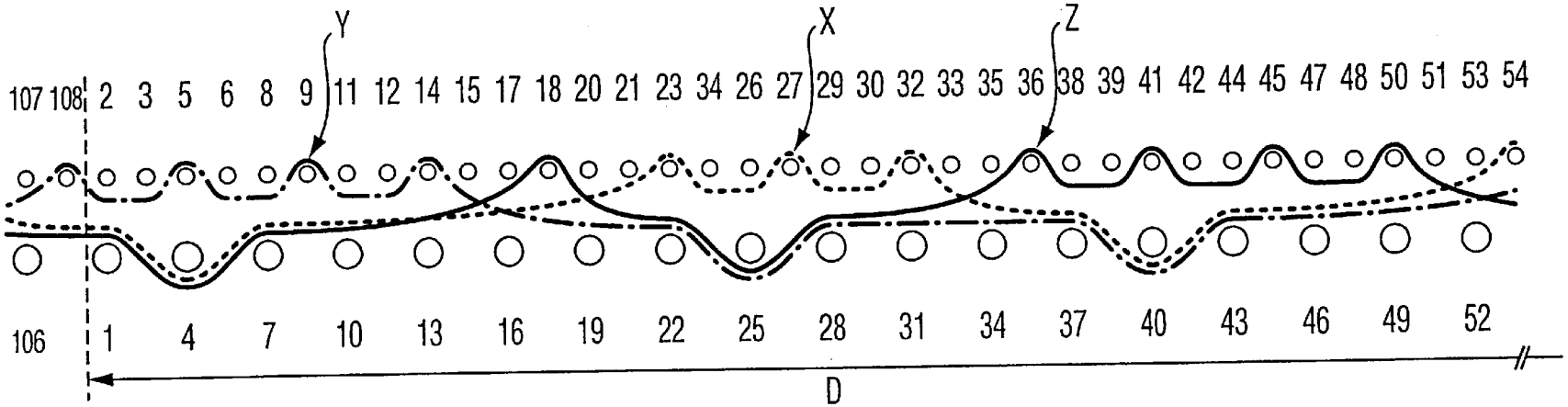
Figure 4B:
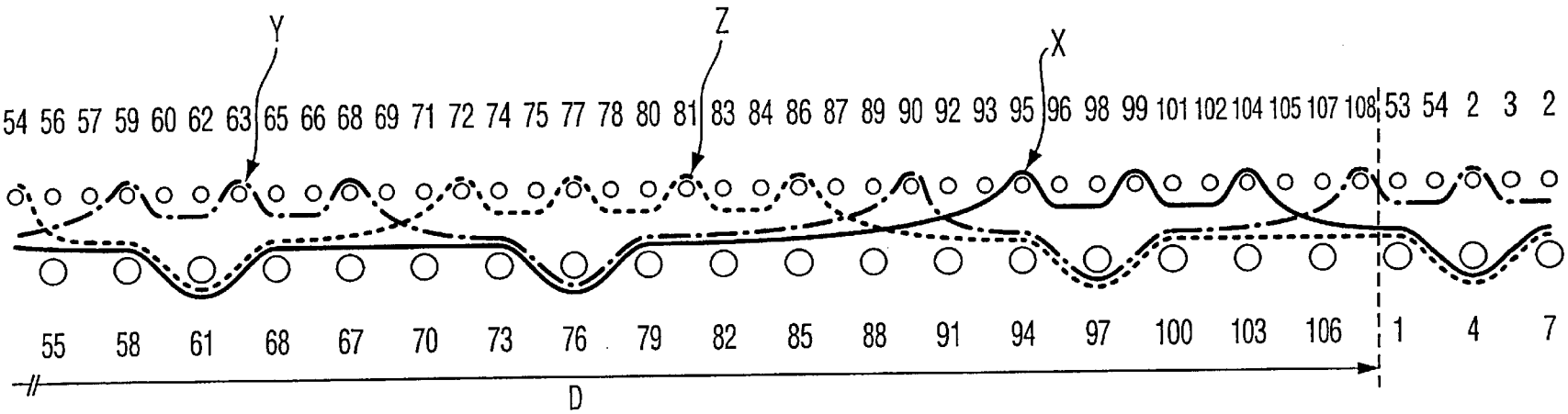

A more complex weave design is shown in FIGS. 4A and 4B combined; for clarity there is some overlap between these two parts of FIG. 4. In this fabric although both the paper side layer and the machine side layer are each relatively simple patterns, the paper side layer is a 3×3 twill, and the machine side layer is the same 6×12 design used in FIG. 1, the pattern repeat requires nine segments:

triplet Y interweaves with wefts 108, 5,9 and 14;
triplet X interweaves with weft 18;
triplet Z interweaves with wefts 23, 27 and 32;
triplet X interweaves with wefts 36, 41, 45 and 50;
triplet Z interweaves with weft 54;
triplet Y interweaves with wefts 59, 63 and 68;
triplet Z interweaves with wefts 72, 77, 81 and 86;
triplet Y interweaves with weft 90; and
triplet X interweaves with wefts 95, 99 and 104.

In the machine side layer there are six interlacing points which are regularly spaced in a repeating sequence of 6 and 4 wefts between each:

triplets X and Z together interlace with weft 4;
triplets X and Y together interlace with weft 25;
triplets Y and Z together interlace with weft 40;
triplets X and Z together interlace with weft 61;
triplets X and Y together interlace with weft 76; and
triplets Y and Z together interlace with weft 97.

Inspection of FIG. 4 shows further features of this invention. In FIGS. 1, 2 and 3 the number of segments is twice the number of interlacing points: for FIG. 1 the numbers are 4 and 2, and for both of FIGS. 2 and 3 the numbers are 6 and 3. In FIG. 4 this ratio is different, with 9 segments and 6 interlacing points. The segments lengths again are not the same, with a repeating sequence of 4 wefts, 1 weft, and 3 wefts within the pattern repeat. It can also be seen that each member X, Y and Z of the warp triplet occupies a essentially the same path within the weave pattern.

As has been previously discussed, the weave structure of the paper side layer must "fit" onto the weave structure of the machine side layer. There are at least three reasons for this.

First, the locations at which a pair of yarns from a triplet of warp yarns interlaces with a machine side layer weft yarn must coincide with the interweaving location with the paper side layer of the third member of the triplet. The weave structures of each layer must therefore be such that this may occur without causing any undue deformation of the paper side layer paper side surface.

Second, the paper side layer and machine side layer weave structures should fit such that the locations at which a pair of yarns from a triplet interlace together with a machine side layer weft is as far removed as possible from the ends of the segment in the paper side layer weave pattern occupied by the third member of the triplet. This will reduce dimpling and any other surface imperfections caused by bringing the third member of the triplet down from the paper side layer into the machine side layer.

Third, the locations at which the pairs of warp yarns from each triplet interlace with the machine side layer weft yarns should be recessed into the machine side layer as much as possible from the wear plane of the machine side layer, so as to extend the fabric service life. This may be accomplished by making the exposed machine side layer float between two successive interlacing points as long as possible. The length of a machine side layer weft float will increase with the number of sheds used to weave the machine side layer pattern. Thus it is generally preferred that the machine side layer of the fabrics of this invention be woven according to patterns requiring at least 4 sheds, and preferably at least 6.

EXPERIMENTAL TRIALS

Three sample fabrics were woven as follows:

Sample fabric A was woven according to the design shown in FIG. 1;

Sample fabric B was woven according to the design shown in FIG. 2;

Sample fabric C was woven according to the design shown in FIG. 3; and

Sample fabric D was woven according to the design shown in FIGS. 4A and 4B.

All of the fabrics were woven using standard round polyester warp and weft yarns. The sample fabrics had the properties shown in Table 2.

TABLE 2

| Fabric Property | Sample A | Sample B | Sample C | Sample D |
|---|---|---|---|---|
| PS Mesh (warp × weft per cm) | 27.6 × 33.1 | 26.8 × 26.4 | 26.8 × 24.8 | 27.6 × 33.1 |
| MS Mesh (warp × weft per cm) | 27.6 × 16.5 | 26.8 × 13.2 | 26.8 × 12.4 | 27.6 × 16.5 |
| Yarn Diameter, Warp | 0.15 | 0.15 | 0.15 | 0.15 |
| Yarn Diameter, PS Weft | 0.13 | 0.14 | 0.15 | 0.13 |
| Yarn Diameter, MS Weft | 0.30 | 0.33 | 0.35 | 0.30 |
| Open Area, % | 41.7 | 37.7 | 46.0 | 41.7 |
| Warp Fill, %, before heat setting | 112 | 112 | 112 | 112 |
| Warp Fill, %, after heat setting | 124 | 120 | 120 | 124 |
| Frames, $cm^{-2}$ | 590.2 | 706.2 | 442.6 | 590.2 |
| Fiber Support Index (Beran) | 142 | 135 | 114 | 142 |
| Air Permeability ($m^3/m^2/hr$) | 6,500 | 7,480 | 7,650 | 6,500 |

In Table 2, PS means "paper side", MS means "machine side", Open Area is measured according to the procedure provided in CPPA Data Sheet G-18 and refers to the portion of the paper side surface of the paper side layer that does not contain warp or weft yarns and is therefore open to allow for drainage of fluid from the web, Warp Fill=(warp diameter× mesh×100)%, Frames $cm^{-2}$ refers to the number of openings, or frames, in one square centimeter of the paper side surface of the paper side layer, Fiber Support Index is determined according to the relationship provided in CPPA Date Sheet G-18 and refers to amount of support provided by the paper side surface of the paper side layer available to support the papermaking fibers in the stock deposited thereon. Air permeabilities were measured according to ASTM D 737-96, using a High Pressure Differential Air Permeability Machine, available from The Frazier Precision Instrument Company, Gaithersburg, Md., USA, and with a pressure differential of 127 Pa through the fabric; the air permeability is measured on the fabric after heat setting.

Selection of appropriate warp and weft yarn diameters for use in the fabrics of this invention will depend on many factors, including the grade of paper product which the fabric will be used to produce and will affect the air permeability of the resulting fabric. Selection of appropriate yarn diameters will be made in accordance with the intended end use of the fabric.

Table 2 shows that the fabrics of this invention provide a relatively high open area, from 38% to 46% for the examples given. This high open area allows fluids to drain easily and uniformly from the incipient paper web into the fabric structure below. Further, the fabrics possess a relatively low air permeability, of from 7,650 down to 6,500 $m^3/m^2/hr$ in the sample fabrics for which data is given in Table 2. Fabric air permeability may be further reduced by appropriate choice of paper side and/or machine side yarn diameter and mesh. By reducing fabric air permeability, fluid drains more slowly through both the paper and machine side fabric layers, which result in improved formation and reduced wire mark. Laboratory analysis of hand sheets produced on the fabric samples described in Table 2 confirms that wire mark is reduced compared to other prior art fabrics, and that the sheets offer improved printability characteristics.

What is claimed is:

1. A forming fabric, having at least a paper side layer and a machine side layer, which comprises weft yarns interwoven with triplet sets of warp yarns according to a repeating pattern wherein:

(a) each member of each triplet set of warp yarns interweaves with the paper side layer weft yarns to occupy in sequence segments of at least one unbroken warp path in the paper side layer;

(b) each segment in the unbroken warp path is separated by at least one paper side layer weft yarn;

(c) each member of each triplet interlaces with at least one machine side layer weft yarn; and (d) the members of each triplet interlace in pairs together with a single machine side layer weft yarn.

2. A fabric according to claim 1 which includes two layers of weft yarns, the first in the paper side layer, and the second in the machine side layer.

3. A fabric according to claim 1 which includes three layers of weft yarns, the first in the paper side layer, the second in the machine side layer, and the third in an intermediate layer.

4. A fabric according to claim 1 wherein the members of each triplet set occupy a single unbroken warp path in the paper side layer.

5. A fabric according to claim 1 wherein the machine side layer is woven according to a weave pattern requiring at least 4 sheds.

6. A fabric according to claim 1 wherein the machine side layer is woven according to a weave pattern requiring at least 6 sheds.

7. A fabric according to claim 1 wherein the fabric after heat setting has a paper side layer open area, when measured by a standard test procedure, of at least 35%.

8. A fabric according to claim 1 wherein the fabric has a warp fill of from about 100% to about 140%.

9. A fabric according to claim 1 wherein the fabric has an air permeability, when measured by a standard test procedure, of from about 3,500 $m^3/m^2/hr$ to about 8,200 $m^3/m^2/hr$, at a pressure differential of 127 Pa through the fabric.

10. A forming fabric according to claim 1 having a paper side layer and a machine side layer, which comprises weft yarns interwoven with triplet sets of warp yarns according to a repeating pattern wherein:

(i) the paper side layer and the machine side layer each comprise warp yarns and weft yarns woven together in a repeating pattern;

(ii) in the paper side surface of the paper side layer the repeating pattern provides a warp yarn path in which the warp yarn floats over 1, 2 or 3 consecutive paper side layer weft yarns;

(iii) each of the triplets of warp yarns occupy an unbroken warp path in the paper side layer; and (iv) the ratio of paper side layer weft yarns to machine side layer weft yarns is chosen from 1:1, 2:1, 3:2, 5:3 and 3:1; wherein the first, second and third members in the triplets of warp yarns are woven such that:

(a) in a first segment of the unbroken warp path:

(1) the first member of the triplet interweaves with a group of paper side layer wefts to occupy a first part of the unbroken warp path in the paper side surface of the paper side layer;

(2) the first member of the triplet floats over 1, 2 or 3 consecutive paper side layer weft yarns; and (3) the second and third members of the triplet interlace together with one weft yarn in the machine side layer;

(b) in a second segment of the unbroken warp path:

(1) the second member of the triplet interweaves with at least one paper side layer weft to occupy a second part of the unbroken warp path in the paper side surface of the paper side layer;

(2) the second member of the triplet floats over 1, 2 or 3 consecutive paper side layer weft yarns; and (3) the first and third members of the triplet pass between the paper side layer wefts and the machine side layer wefts;

(c) in a third segment of the unbroken warp path:

(1) the third member of the triplet interweaves with a group of paper side layer wefts to occupy a third part of the unbroken warp path in the paper side surface of the paper side layer;

(2) the third member of the triplet floats over 1, 2 or 3 consecutive paper side layer weft yarns; and (3) the first and second members of the triplet interlace together with one weft yarn in the machine side layer;

(d) in a fourth segment of the unbroken warp path:

(1) the second member of the triplet interweaves with at least one paper side layer weft to occupy a fourth part of the unbroken warp path in the paper side surface of the paper side layer;

(2) the second member of the triplet floats over 1, 2 or 3 consecutive paper side layer weft yarns; and (3) the first and third members of the triplet pass between the paper side layer wefts and the machine side layer wefts;

(e) the locations of the second and fourth segments are regularly spaced and are the same number of wefts apart;

(f) the interlacing points in the machine side layer are not the same distance apart;

(g) the first and third segments are of equal or unequal length;

(h) the second and fourth segments are of equal or unequal length;

(i) the unbroken warp path in the paper side surface of the paper side layer occupied in turn by the first, second and third member of each triplet of warp yarns has a single repeat pattern;

(j) in the unbroken warp path in the paper side surface of the paper side layer occupied in turn by the first, second and third members of each triplet of warp yarns, each succeeding segment is separated in the paper side surface of the paper side layer by at least one paper side layer weft yarn;

(k) in the fabric the weave pattern of the second member of a triplet of warp yarns is different to the weave pattern of the first and third members of the triplet, and (1) in the fabric the weave patterns of the first and third members of a triplet of warp yarns are the same or different.

11. A forming fabric according to claim 1 having a paper side layer and a machine side layer, which comprises weft yarns interwoven with triplet sets of warp yarns according to a repeating pattern wherein:

(i) the paper side layer and the machine side layer each comprise warp yarns and weft yarns woven together in a repeating pattern;

(ii) in the paper side surface of the paper side layer the repeating pattern provides a warp yarn path in which the warp yarn floats over 1, 2 or 3 consecutive paper side layer weft yarns;

(iii) each of the triplets of warp yarns occupy an unbroken warp path in the paper side layer; and (iv) the ratio of paper side layer weft yarns to machine side layer weft yarns is chosen from 1:1, 2:1, 3:2, 5:3 and 3:1;

wherein the first, second and third members in the triplets of warp yarns are woven such that:

(a) in a first segment of the unbroken warp path:

(1) the first member of the triplet interweaves with a group of paper side layer wefts to occupy a first part of the unbroken warp path in the paper side surface of the paper side layer;

(2) the first member of the triplet floats over 1, 2 or 3 consecutive paper side layer weft yarns; and (3) the second and third members of the triplet interlace together with one weft yarn in the machine side layer;

(b) in a second segment of the unbroken warp path:

(1) the second member of the triplet interweaves with at least one paper side layer weft to occupy a second part of the unbroken warp path in the paper side surface of the paper side layer;

(2) the second member of the triplet floats over 1, 2 or 3 consecutive paper side layer weft yarns; and (3) the first and third members of the triplet pass between the paper side layer wefts and the machine side layer wefts;

(c) in a third segment of the unbroken warp path:

(1) the third member of the triplet interweaves with a group of paper side layer wefts to occupy a third part of the unbroken warp path in the paper side surface of the paper side layer;

(2) the third member of the triplet floats over 1, 2 or 3 consecutive paper side layer weft yarns; and (3) the first and second members of the triplet interlace together with one weft yarn in the machine side layer;

(d) in a fourth segment of the unbroken warp path:

(1) the first member of the triplet interweaves with at least one paper side layer weft to occupy a fourth part of the unbroken warp path in the paper side surface of the paper side layer;

(2) the first member of the triplet floats over 1, 2 or 3 consecutive paper side layer weft yarns; and (3) the second and third members of the triplet pass between the paper side layer wefts and the machine side layer wefts;

(e) in a fifth segment of the unbroken warp path:

(1) the second member of the triplet interweaves with a group of paper side layer wefts to occupy a fifth part of the unbroken warp path in the paper side surface of the paper side layer;

(2) the second member of the triplet floats over 1, 2 or 3 consecutive paper side layer weft yarns; and (3) the first and third members of the triplet interlace together with one weft yarn in the machine side layer; and (f) in a sixth segment of the unbroken warp path:

(1) the third member of the triplet interweaves with at least one paper side layer weft to occupy a sixth part of the unbroken warp path in the paper side surface of the paper side layer;

(2) the third member of the triplet floats over 1, 2 or 3 consecutive paper side layer weft yarns; and (3) the first and second members of the triplet pass between the paper side layer wefts and the machine side layer wefts;

(g) the first, third and fifth segments are of equal or unequal length;

(h) the second, fourth and sixth segments are of equal or unequal length;

(i) the unbroken warp path in the paper side surface of the paper side layer occupied in turn by the first, second and third member of each triplet of warp yarns has a single repeat pattern;

(j) in the unbroken warp path in the paper side surface of the paper side layer occupied in turn by the first, second and third members of each triplet of warp yarns, each succeeding segment is separated in the paper side surface of the paper side layer by at least one paper side layer weft yarn;

(k) the interlacing points in the machine side layer are the same distance apart; and (l) in the fabric the weave pattern of each member of a triplet of warp yarns is the same, or different, to the weave pattern of at least one other member of the triplet.

12. A forming fabric according to claim 1 having a paper side layer and a machine side layer, which comprises weft yarns interwoven with triplet sets of warp yarns according to a repeating pattern wherein:

(i) the paper side layer and the machine side layer each comprise warp yarns and weft yarns woven together in a repeating pattern;

(ii) in the paper side surface of the paper side layer the repeating pattern provides a warp yarn path in which the warp yarn floats over 1, 2 or 3 consecutive paper side layer weft yarns;

(iii) each of the triplets of warp yarns occupy an unbroken warp path in the paper side layer; and (iv) the ratio of paper side layer weft yarns to machine side layer weft yarns is chosen from 1:1, 2:1, 3:2, 5:3 and 3:1;

wherein the first, second and third members in the triplets of warp yarns are woven such that:

(a) in a first segment of the unbroken warp path:

(1) the first member of the triplet interweaves with a group of paper side layer wefts to occupy a first part of the unbroken warp path in the paper side surface of the paper side layer;

(2) the first member of the triplet floats over 1, 2 or 3 consecutive paper side layer weft yarns; and (3) the second and third members of the triplet interlace together with one weft yarn in the machine side layer;

(b) in a second segment of the unbroken warp path:

(1) the second member of the triplet interweaves with at least one paper side layer weft to occupy a second part of the unbroken warp path in the paper side surface of the paper side layer;

(2) the second member of the triplet floats over 1, 2 or 3 consecutive paper side layer weft yarns; and (3) the first and third members of the triplet pass between the paper side layer wefts and the machine side layer wefts;

(c) in a third segment of the unbroken warp path:

(1) the third member of the triplet interweaves with a group of paper side layer wefts to occupy a third part of the unbroken warp path in the paper side surface of the paper side layer;

(2) the third member of the triplet floats over 1, 2 or 3 consecutive paper side layer weft yarns; and (3) the first and second members of the triplet interlace together with one weft yarn in the machine side layer;

(d) in a fourth segment of the unbroken warp path:

(1) the second member of the triplet interweaves with a group of paper side layer wefts to occupy a fourth part of the unbroken warp path in the paper side surface of the paper side layer;

(2) the second member of the triplet floats over 1, 2 or 3 consecutive paper side layer weft yarns; and (3) the first and third members of the triplet interlace together with one weft yarn in the machine side layer;

(e) in a fifth segment of the unbroken warp path:

(1) the third member of the triplet interweaves with at least one paper side layer weft to occupy a fifth part of the unbroken warp path in the paper side surface of the paper side layer;

(2) the third member of the triplet floats over 1, 2 or 3 consecutive paper side layer weft yarns; and (3) the first and second members of the triplet pass between the paper side layer wefts and the machine side layer wefts;

(f) in a sixth segment of the unbroken warp path:

(1) the first member of the triplet interweaves with a group of paper side layer wefts to occupy a sixth part of the unbroken warp path in the paper side surface of the paper side layer;

(2) the second member of the triplet floats over 1, 2 or 3 consecutive paper side layer weft yarns; and (3) the second and third members of the triplet interlace together with one weft yarn in the machine side layer;

(g) in a seventh segment of the unbroken warp path:

(1) the third member of the triplet interweaves with a group of paper side layer wefts to occupy a seventh part of the unbroken warp path in the paper side surface of the paper side layer;

(2) the third member of the triplet floats over 1, 2 or 3 consecutive paper side layer weft yarns; and (3) the first and second members of the triplet interlace together with one weft yarn in the machine side layer;

(h) in an eighth segment of the unbroken warp path:

(1) the first member of the triplet interweaves with at least one paper side layer weft to occupy a fifth part of the unbroken warp path in the paper side surface of the paper side layer;

(2) the first member of the triplet floats over 1, 2 or 3 consecutive paper side layer weft yarns; and (3) the second and third members of the triplet pass between the paper side layer wefts and the machine side layer wefts;

(i) in a ninth segment of the unbroken warp path:

(1) the second member of the triplet interweaves with a group of paper side layer wefts to occupy a ninth part of the unbroken warp path in the paper side surface of the paper side layer;

(2) the second member of the triplet floats over 1, 2 or 3 consecutive paper side layer weft yarns; and (3) the second and third members of the triplet interlace together with one weft yarn in the machine side layer;

(j) the first, third, fourth, sixth, seventh and ninth segments are unequal length;

(k) the second, fifth, eighth and tenth segments are of equal length;

(l) the unbroken warp path in the paper side surface of the paper side layer occupied in turn by the first, second and third member of each triplet of warp yarns has a single repeat pattern;

(m) in the unbroken warp path in the paper side surface of the paper side layer occupied in turn by the first, second and third members of each triplet of warp yarns, each succeeding segment is separated in the paper side surface of the paper side layer by at least one paper side layer weft yarn;

(n) the interlacing points in the machine side layer are not the same distance apart; and (o) in the fabric the weave pattern of each member of a triplet of warp yarns is the same as the other members of the triplet.

* * * * *